US007431179B2

(12) United States Patent
Ritter

(10) Patent No.: US 7,431,179 B2
(45) Date of Patent: Oct. 7, 2008

(54) TWO-CHAMBER CARTRIDGE

(76) Inventor: Frank Georg Ritter, Plamer-Singer-Strasse 1, 87745 Eppishausen (DE)

( * ) Notice: Subject to any disclaimer, the term of this patent is extended or adjusted under 35 U.S.C. 154(b) by 510 days.

(21) Appl. No.: 11/325,238

(22) Filed: Jan. 3, 2006

(65) Prior Publication Data

US 2006/0180598 A1 Aug. 17, 2006

(30) Foreign Application Priority Data

Jan. 4, 2005 (DE) ..... 10 2005 000 757

(51) Int. Cl.
*B67D 5/52* (2006.01)

(52) U.S. Cl. ..... 222/137; 222/135; 222/162

(58) Field of Classification Search ..... 222/137, 222/132, 135, 162
See application file for complete search history.

(56) References Cited

U.S. PATENT DOCUMENTS 2,826,339 A * 3/1958 Maillard ..... 222/137
4,029,236 A 6/1977 Carson, Jr. et al.
4,050,612 A 9/1977 Stone
4,220,261 A * 9/1980 White ..... 222/135
4,961,520 A 10/1990 White
5,139,171 A * 8/1992 Mader ..... 222/137
7,237,693 B2 * 7/2007 Brennan et al. ..... 222/327

FOREIGN PATENT DOCUMENTS

EP 0 624 403 11/1994

* cited by examiner

*Primary Examiner*—Kevin P. Shaver
*Assistant Examiner*—Hyea J Choi
(74) *Attorney, Agent, or Firm*—Klaus J. Bach

(57) ABSTRACT

In a two chamber cartridge with chambers arranged axially one after the other, wherein the front chamber in a front part of the cartridge interior is divided by a double wall insert into an outer partial chamber and an inner partial chamber which are both closed at the rear ends by pistons and the rear chamber is formed by a beaker which is inserted into the rear of the cartridge and has a beaker bottom with a pin extending from the beaker bottom through an annular piston closing the beaker, the rear end of the double wall insert abuts the annular piston closing the beaker and the annular piston includes passages leading to gap between the two spaced walls of the double wall insert and the two front partial chambers and the intermediate space are in communication with a mouthpiece space at the front end of the cartridge.

3 Claims, 3 Drawing Sheets

TWO-CHAMBER CARTRIDGE

BACKGROUND OF THE INVENTION

The invention relates to a multi-chamber cartridge for multi-component plastic materials such as silicon, cement etc. . . with chambers arranged axially one behind the other for the reception of the two components.

Besides the well-known standard arrangements for two component cartridges with longitudinal separation of a cylindrical cartridge tube into two chambers by means of an intermediate separation wall or a co-axial inner tube (newer arrangement in the form of a co-axial cartridge), two-chamber cartridges with chambers arranged axially behind one another are also known. Examples here for can be found in U.S. Pat. Nos. 4,050,612, 4,029,236, and 4,961,520 as well as EP-0-624 403 a1

In the arrangement disclosed in EP-0 624 403 A1, the two chambers each include a piston for pressing the two components out of the cartridge. The components are disposed in a cylindrical cartridge tube axially one behind the other. The first chamber is formed between the cartridge tube and an inner tube which is arranged concentrically with the cartridge tube. This annular chamber is closed by an annular piston disposed in the back. The second chamber disposed axially behind the first chamber is formed by a piston which, forwardly, becomes wider in a beaker-like manner, and has a wall which abuts the inner wall of the cartridge tube. The beaker-like piston abuts with its front edge the annular piston of the first chamber so that, upon application of a pressure to the piston closing the rear chamber, the pressure is transmitted to the annular piston closing the front chamber and both pistons are advanced in unison. The rear chamber further includes a central lug which projects from the piston of the rear chamber forwardly and which enters the inner tube of the front chamber when the rear piston is moved forwardly. At its front end, the rear chamber is delimited by a radial wall which is disposed adjacent the end of the inner tube of the front chamber and which abuts with its outer end the inner beaker wall of the rear chamber.

The design of the known two-chamber cartridges requires the filling of the cartridge chambers after assembly of the cartridge from the discharge end which is relatively complicated and requires special equipment. In addition, the venting during filling is problematic.

It is the object of the present invention to provide a two-chamber cartridge with chambers arranged axially one after the other wherein each of the chambers can be filled easily with a standard filling apparatus.

SUMMARY OF THE INVENTION

In a two chamber cartridge with chambers arranged axially one after the other, wherein the front chamber in a front part of the cartridge interior is divided by a double wall insert into an outer partial chamber and an inner partial chamber which are both closed at the rear ends by pistons and the rear chamber is formed by a beaker which is inserted into the rear of the cartridge and has a beaker bottom with a pin extending from the beaker bottom through an annular piston closing the beaker, the rear end of the double wall insert abuts the annular piston closing the beaker and the annular piston includes passages leading to gap between the two spaced walls of the double wall insert and the two front partial chambers and the intermediate space are in communication with a mouthpiece space at the front end of the cartridge.

Details of the arrangement according to the invention will become more readily apparent from the following description of a particular embodiment thereof on the basis of the accompanying drawings.

DESCRIPTION OF A PREFERRED EMBODIMENT

Figure 1:
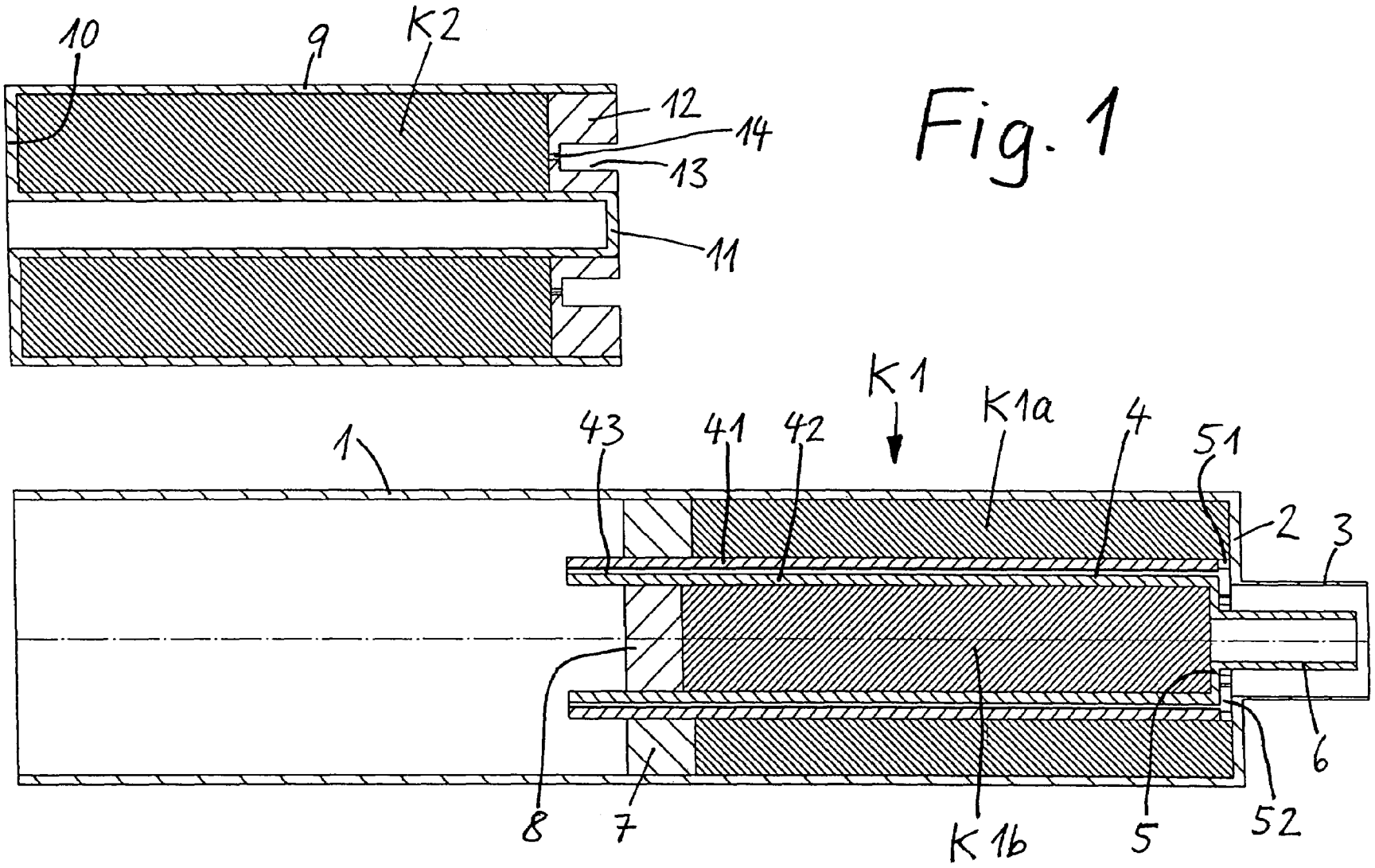
FIG. 1 is an axial cross-sectional view of a two-chamber cartridge according to the invention shown with the chambers filled but the rear chamber not yet inserted into the cartridge.

As shown in the figures, the two-chamber cartridge according to the invention comprises a cartridge tube 1 which is open at its rear end but which has a front end wall 2 with an outer mouth piece 3 formed thereon, a double-wall insert 4 concentrically disposed in the front part of the cartridge tube 1 and including a front end wall 5 with an inner mouth piece 6, which extends concentrically with the outer mouthpiece 3. A piston structure with an annular piston 7 and a central piston 8 for closing off of the front end component chamber K1 is provided in the front part of the cartridge tube and a beaker 9 with a beaker bottom wall 10 forming a rear chamber K2 is disposed in the rear part of the cartridge tube 1 with a central hollow pin 11 extending from the bottom wall 10 and an annular piston 12 closing the open front end of the beaker 9.

Figure 2:
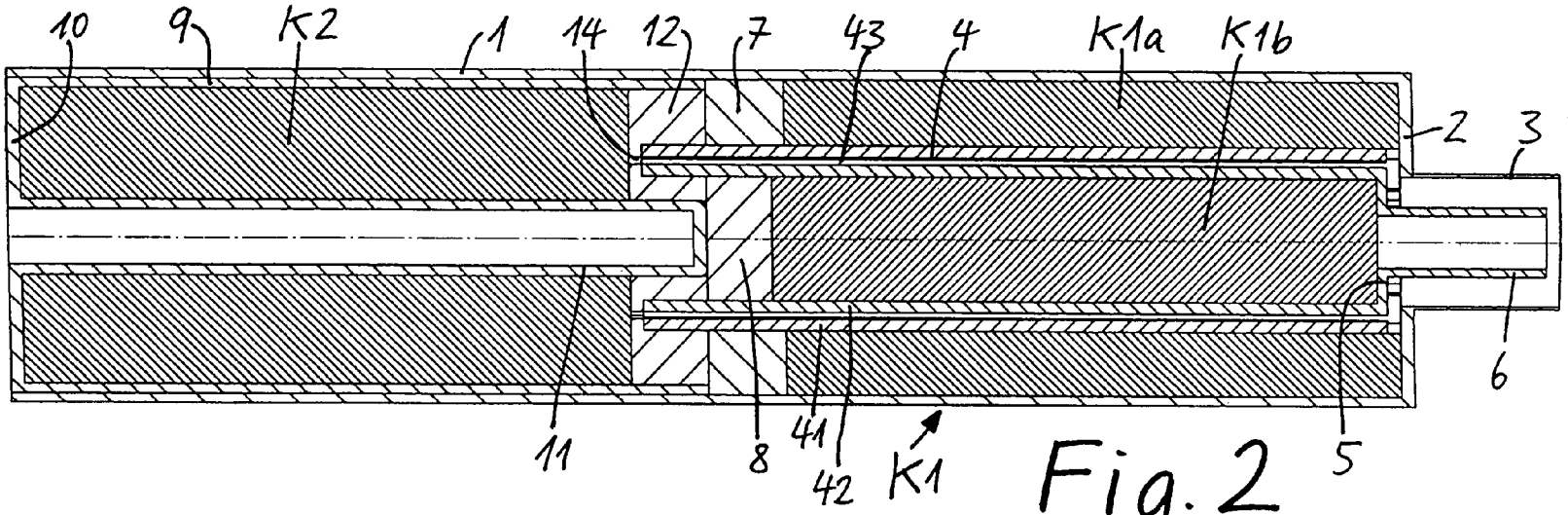
FIG. 2 shows the two-chamber cartridge ready for use.

In the figures, the different fillings of the front chamber K1 and of the rear chamber K2 are shown in each case by hatching. FIG. 1 shows the state of the two-chamber cartridges at the end of the manufacturing step wherein the material component chambers K1 and, respectively, K2 are already filled and closed by the respective pistons 7, 8 and 12, but the cartridge tube 1 and the beaker 9 are still separate. In FIG. 2, the beaker 9 is inserted into the rear part of the cartridge and the two-chamber cartridge is ready for use, that is, the outpressing of the material components may begin.

First, some details concerning the cartridge arrangement as shown in FIG. 1 will be described:

As already mentioned a double wall insert is disposed in the front part of the cartridge tube 1. Within the front part of the cartridge tube 1, the double-wall insert forms a double wall tube and divides the front part of the interior space of the cartridge tube 1 into an annular outer partial chamber K1*a* and an inner partial chamber K1*b*. The two partial chambers are filled with the same first material component but are not in communication. This arrangement permits the optional use of the cartridge according to the invention as a three-chamber cartridge for three-material components.

The double wall insert 4 forms with its two concentric tube walls 41 and 42, an annular gap 43, which, as will be described below, forms a flow channel for the rear chamber K2, that is, for the material component contained in the beaker 9 to the mouthpiece arrangement 3, 6. The insert 4 is suitably connected to the front end wall 2 of the cartridge tube 1, which may be accomplished by a locking structure in a known way which is not shown in the drawing, by ultrasound welding, by cementing or another connecting structure. Of course, the insert may be centered by suitable arrangements which are known to the person skilled in the art but not shown in the schematic drawings.

As apparent from the drawing, the front end wall 5 of the insert 4 is such that the inner partial chamber K1*b* is closed by the front wall onto which the mouthpiece 6 is formed, so that the inner partial chamber K1*b* can be emptied via the mouthpiece 6. As further apparent, the front end wall 5 of the insert 4 forms with correspondingly arranged ribs, grooves etc. openings 51, 52 which provide for communication between the outer partial chamber K1*a* and the annular space between the outer mouthpiece 3 and the inner mouthpiece 6 and also between the gap 43 between the tube walls 41, 42 of the insert 4 and the annular space between the outer and the inner mouthpieces 3 and 6.

The annular piston 12 which closes the beaker 9 and, consequently, the rear chamber K2 includes an annular axial groove 13, which, as can be seen from the various figures, is complementary to the rear end area of the insert 4 which projects beyond the pistons 7, 8. As a result, the rear end area enters the annular groove 13 when the beaker 9 is inserted into the cartridge tube 1. Furthermore, the annular piston 12 includes a plurality of bores 14 arranged in annularly spaced relationship and extending through the bottom wall of the groove 43. Through these bores 14, the second material component can flow from the rear chamber K2 into the space between the tubular walls 41, 42 of the insert 4 when the beaker is inserted into the cartridge tube 1 as shown in FIG. 2 and through which it can flow to the annular space between the inner and outer mouthpieces 6, 3. The means for sealing the two chambers until the cartridge is used, that is, the front chamber K1 in the area of the mouthpiece and the rear chamber K2 for example by a sealing foil disposed over the annular piston 12 are not shown in the drawings for simplicity reasons.

The FIGS. 2 to 5 show the operation of the two chamber cartridge.

FIG. 2 shows the cartridge ready for use. The front end wall of the annular piston 12 of the beaker 9 inserted into the cartridge tube 1 is disposed at the rear end walls of the pistons 7 and 8. The bottom of the annular groove 13 in the annular piston 12 abuts the rear end face of the tubular insert walls 41, 42; the front face of the tubular wall of the beaker 9 abuts the rear end wall of the annular piston 7 and the front end face of the hollow pin 11 abuts the rear end face of the inner piston 8.

Now when pressure is applied to the rear beaker bottom 10 by a common cartridge press, the beaker 9 is advanced within the cartridge 1. As a result, the annular piston 12 is properly seated by the insert 4 and fixed axially while the annular piston 7 and the inner piston 8 are moved forward by the tubular wall of the beaker 9 or, respectively, by the center pin 11. The two chambers K1 (consisting of the partial chambers K1*a* and K1*b*) and K2 become axially smaller at the same rate so that the material is pressed out of the chambers K1 and K2. From the front partial chamber K1*a*, the material flows through the openings 51 into the annular space between the outer mouthpiece 3 and the inner mouthpiece 6. The material from the inner partial chamber K1*b* flows into the inner mouthpiece 6 and the material from the rear chamber k2 flows through the annular gap 43 between the insert tubes 41, 42 and through the outlet openings 52 also into the annular space between the outer mouthpiece 3 and the inner mouthpiece 6. From the mouthpiece arrangement, the material flows from the annular space between the outer and the inner mouthpieces 3, 6 and the material from the inner mouthpiece 6 flows into a mixing chamber disposed on the mouthpiece arrangement in which the material components of the two chambers K1 and K2 (or if the cartridge is a three-chamber cartridge, from all three cartridges) are intensely mixed.

Figure 3:
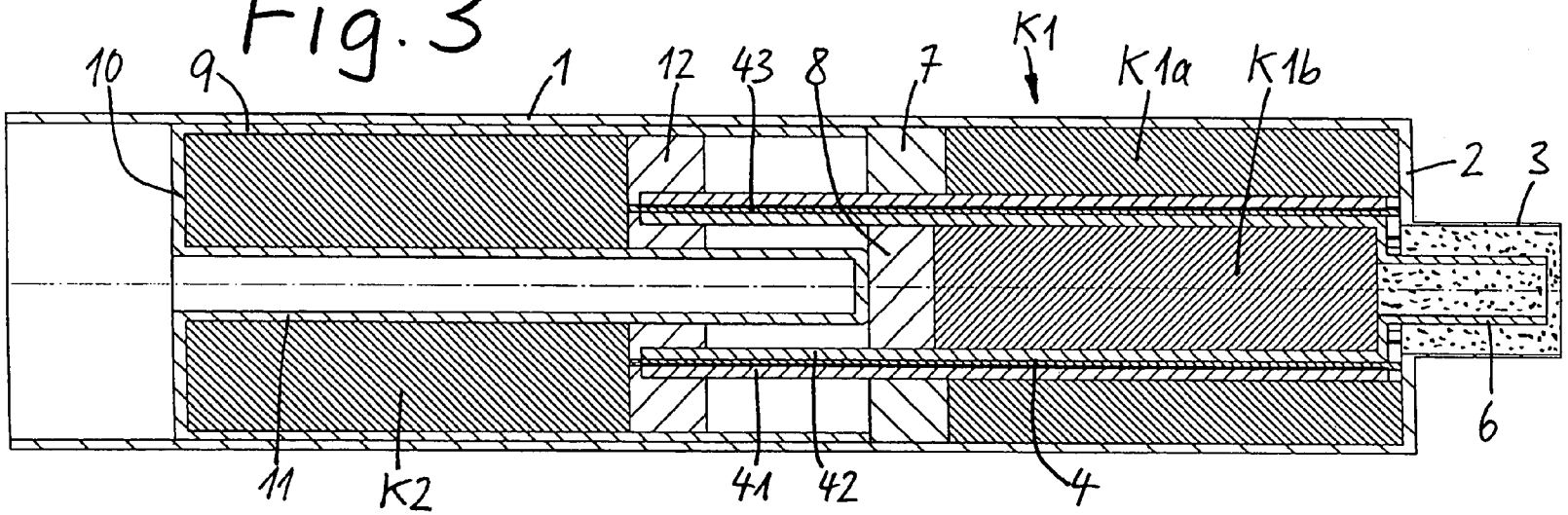
FIG. 3 shows the cartridge of FIG. 2 after an initial phase of pressing material out of the cartridge.
Figure 4:
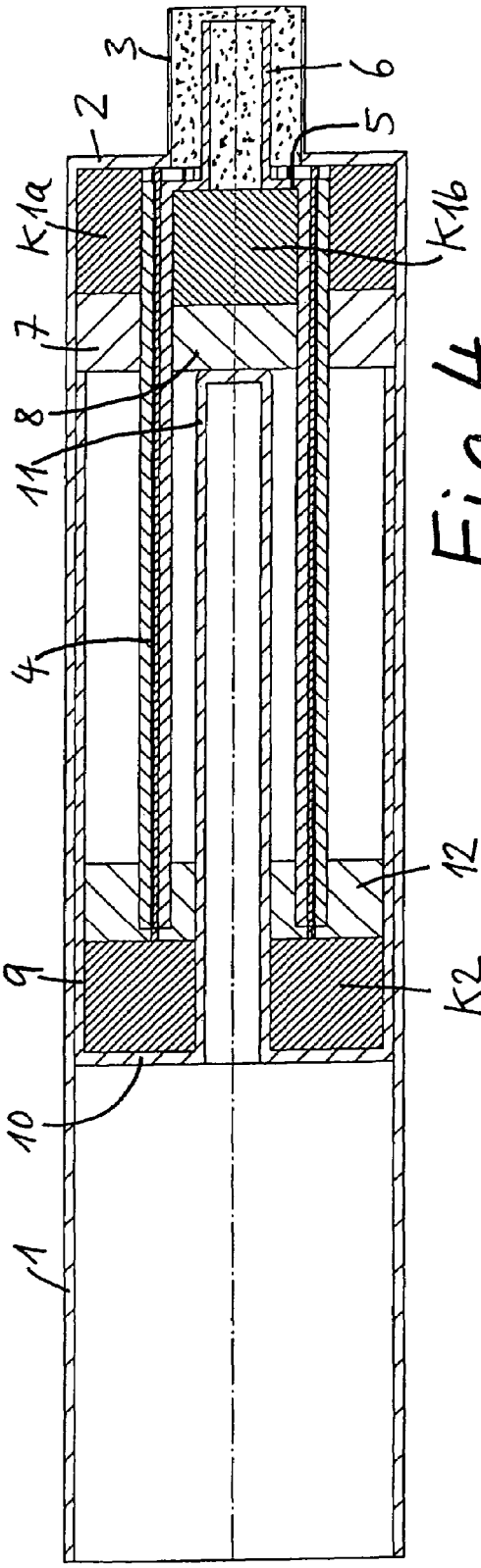
FIG. 4 shows the cartridge with the content largely discharged.
Figure 5:
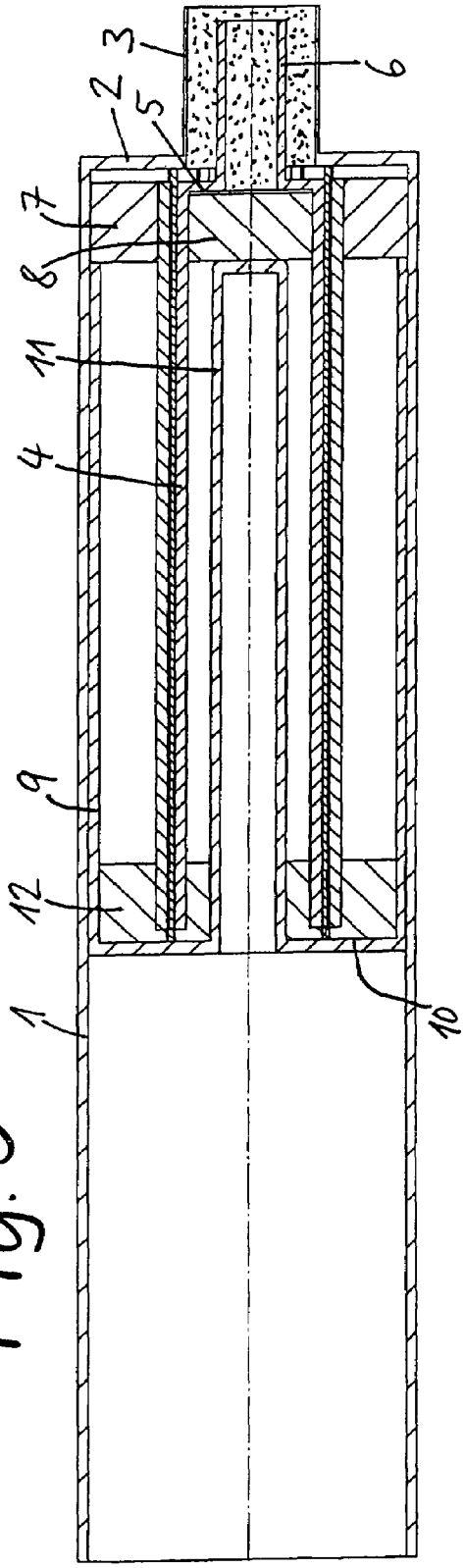
FIG. 5 shows the cartridge fully emptied.

FIGS. 3 and 4 show intermediate positions during the outpressing procedure. FIG. 5 shows the end state when the cartridge is completely emptied. As apparent from the figure, the cartridge is practically fully emptied without any rest material remaining in the chambers. A small residual amount remains in the mouthpiece area and some also in the annular space 43 between the insert tube walls 41, 42.

As readily apparent to a person skilled in the art, the mixing ratios can be selected by an appropriate selection of the relative cross-sections of the component chambers K1 and K2 in a wide range. For example, the cross-section of the rear chamber K2 in the beaker 9 can be changed by providing a hollow pin 11 of increased or reduced diameter or by reducing the outer diameter of the beaker 9 and providing radial ribs on the outer wall of the beaker for supporting it on the inner wall of the cartridge tube 1.

What is claimed is:

1. A two-chamber cartridge for two-component plastic materials with storage chambers (K1, K2) arranged axially one after the other, comprising: a cartridge tube (1) having an open rear end and a front end wall (2) with an outer mouthpiece (3) projecting from the front end wall (2), a double-walled insert (4) disposed centrally in the front part of the cartridge tube (1) and consisting of two concentric spaced tube walls (41, 42) forming an annular gap (43) therebetween, said insert (4) dividing the front part of the cartridge interior into an annular outer partial chamber (K1*a*) and an inner partial chamber (K1*b*), said insert (4) being open at its rear end and closed at its front end by an end wall (5), an inner mouthpiece (6) extending from the end wall (5) into the outer mouthpiece (3) of the cartridge tube (1) and passages (51, 52) being provided between the annular partial chamber (K1*a*) as well as the annular gap (43) and the space between the outer mouthpiece (3) and the inner mouthpiece (6), an annular piston (7) closing the rear end of the outer partial chamber (K1*a*) and an inner piston (8) closing the rear end of the inner partial chamber (K1*b*), a beaker (9) inserted into the rear open end of the cartridge tube (1) and having a beaker bottom wall (10) and a center pin (11) extending centrally from the bottom wall (10), and an annular piston (12) closing the open front end of the beaker (9) and being disposed between the beaker wall and the center pin (11) and having passages (14) formed therein, said arrangement being such that the wall of the beaker (9) abuts with its front edges the annular piston (7) closing the annular partial chamber (K1*a*), the pin (11) abuts with its front end face, the piston (8) closing the inner partial chamber (K1*b*), the insert (4) abuts with the rear end faces of its tubular walls (41, 42) the annular piston (12) closing the beaker (9), and the passages (14) in the annular piston (12) closing the beaker (9) extending to the annular gap (43) between the spaced tubular walls (41, 42) of the insert (4).

2. A cartridge according to claim 1, wherein the tubular walls (41, 42) of the insert (4) extend by a predetermined distance beyond the rear end face of the pistons (7, 8) closing the partial chambers (K1*a*, K1*b*) and the annular piston (12) closing the beaker (9) has an axial annular groove (13) complementary to the extension of the insert (4).

3. The use of the two-chamber cartridge according to claim 1 as a three-chamber cartridge for three material components of which a first is disposed in the rear chamber (K2) formed by the beaker (9), a second is disposed in the annular partial chamber (K1*a*)and the third is disposed in the inner partial chamber (K1*b*) formed in the front part of the cartridge tube (1).

* * * * *